US006590476B2

(12) United States Patent
Lee et al.

(10) Patent No.: US 6,590,476 B2
(45) Date of Patent: Jul. 8, 2003

(54) LOWPASS FILTER FOR HIGH FREQUENCY APPLICATIONS

(75) Inventors: Moon Que Lee, Taejon (KR); Keun Kwan Ryu, Taejon (KR); In Bok Yom, Taejon (KR); Seong-Pal Lee, Taejon (KR)

(73) Assignee: Electronics and Telecommunications Research Institute, Taejon (KR)

( * ) Notice: Subject to any disclaimer, the term of this patent is extended or adjusted under 35 U.S.C. 154(b) by 0 days.

(21) Appl. No.: 10/029,941

(22) Filed: Dec. 31, 2001

(65) Prior Publication Data

US 2002/0109566 A1 Aug. 15, 2002

(30) Foreign Application Priority Data

Nov. 2, 2001 (KR) ..... 2001-68081

(51) Int. Cl.[7] ..... H01P 1/203
(52) U.S. Cl. ..... 333/204; 333/172
(58) Field of Search ..... 333/172, 176, 333/204, 175, 185, 219

(56) References Cited

U.S. PATENT DOCUMENTS

| | | | | | |
|---|---|---|---|---|---|
| 5,237,296 | A | * | 8/1993 | Mandai et al. | 333/204 |
| 5,491,367 | A | * | 2/1996 | Schinzel | 333/172 |
| 6,140,892 | A | * | 10/2000 | Uda et al. | 333/204 |
| 2002/0047757 | A1 | * | 4/2002 | Manku et al. | 333/170 |
| 2002/0070814 | A1 | * | 6/2002 | Dixon et al. | 333/172 |

FOREIGN PATENT DOCUMENTS

JP 04186910 A * 7/1992

OTHER PUBLICATIONS

Thomas Garvens; Microstrip LPF Design RF Applications; Motorola, Inc.; p. 147–159.

Yongxi Qian, et al; Microwave Applications of Photonic Band–Gap (PBG) Structures; IEEE 1999; p. 315–318.

Jyh–Wen Sheen; A Compact Semi–Lumped Low–Pass Filter for Harmonics and Spurious Suppression; IEEE Microwave and Guided Wave Letters, vol. 10, No. 3; Mar. 2000; p. 92–93.

* cited by examiner

*Primary Examiner*—Seungsook Ham
(74) *Attorney, Agent, or Firm*—Jacobson Holman PLLC

(57) ABSTRACT

The present invention relates to a lowpass filter for effectively suppress a spurious in stop-band. The lowpass filter includes an input port microstrip element; an output port microstrip element; a first open-ended microstrip element; a second open-ended microstrip element; a first connector microstrip element; and, a second connector microstrip element. The each open-ended microstrips of the present invention is composed of distributed elements and distributed resistances connected each others in series and operated as a capacity, has a large impedance of the microstrip by low influence of a resistance in case of a low frequency, and has a small impedance of the microstrip by high influence of a resistance value in case of a high frequency. The present invention can effectively suppress the spurious characteristic, which is a disadvantage of the conventional lowpass filter composed of transmission lines at the RF band or the microwave band, by inserting resistance elements in open-ended microstrips.

5 Claims, 5 Drawing Sheets

LOWPASS FILTER FOR HIGH FREQUENCY APPLICATIONS

FIELD OF THE INVENTION

The present invention relates to a lowpass filter; and, more particularly, to a lowpass filter for effectively suppressing a spurious in a stop-band, which is generated from a filter operating in a high frequency band including a Radio Frequency (RF) band or a microwave band.

DESCRIPTION OF THE RELATED ARTS

Generally, a conventional lowpass filter is composed of a transmission line in the Radio Frequency RF or the microwave band and has a spurious characteristic due to a periodic characteristic of the transmission line in a stop-band.

Referring to FIGS. 1 and 2, in a conventional lowpass filter implemented by using microstrips, an input port 210 and an output port 270 are microstrips with a characteristic impedance as an impedance of an input/output ports.

Capacitors 120, 140 and 160 in FIG. 1 are implemented by using Open-ended microstrips 220, 240 and 260 in FIG. 2. Capacitances corresponding to the open-ended microstrips 220, 240 and 260 are determined by a line-width, a line-length and an operation frequency of the microstrips.

Microstrip lines 230 and 250 connect the open-ended microstrips 220 to the open-ended microstrips 240 and the open-ended microstrips 240 to the open-ended microstrips 260, respectively. The microstrip lines 230 and 250 at FIG. 2 are operated as inductors 130 and 150 of FIG. 1 at especially cutoff frequency.

A circuitry employing with microstrips in FIG. 2 has the similar result with a circuit in FIG. 1 in a low frequency band. However, in a high frequency band, the results of the circuitry in FIG. 2 show a difference results with a circuit in FIG. 1. Such a difference in results has been a problem of the conventional lowpass filter shown in FIG. 2.

Referring to FIG. 3, "A" and "B" denote an insertion loss and a reflection loss of the conventional lowpass filter shown in FIG. 2.

A dotted line in a graph of FIG. 3 represents a spurious response of the conventional lowpass filter. As shown, un-wanted spurious characteristics appear in the stop-band. The spurious characteristics in the stop-band are due to a periodical impedance change characteristic of microstrip structure of the conventional lowpass filter.

For suppressing such a problem, conventional techniques have been introduced and described in an article by T. Garvens, "Microwave LPF design for RF Application", 1995, *RF Expo,* pp. 147–159, (1995); by J. W. Sheen, "A compact semi-lumped lowpass filter for harmonics and spurious suppression", *IEEE Microwave and Guided Wave Letters, vol,* 10, pp.392–93, (March 2000); by Y. Qian and et al., "Microwave applications of photonic band-gap(PBG) structures", 1999 *IEEE International Microwave Symposium,* (June, 1999).

Garvens introduces a method for improving a spurious response by avoiding a periodical structure according to a specified frequency band. By changing a shape of microstrips in a microstrips type lowpass filter, the periodical characteristic with respect to frequency can be avoided. However, the method only improves a spurious response characteristic in a specified frequency band but not in a broad frequency band. The method cannot be implemented at the broad frequency band.

Sheen proposes a semi-lumped type lowpass filter for improving a spurious response by altering a harmonic frequency according to periodical characteristic of microstrip with respect to a frequency. For avoiding the spurious response, the semi-lumped type lowpass filter is proposed, which is composed of lumped elements and microstrips in parallel connection. The semi-lumped lowpass filter improves the spurious response characteristic of the conventional lowpass filter in a narrow frequency band; however, in broad frequency band, the semi-lumped type lowpass filter cannot improves spurious response characteristic. Qian et al. introduces a method for improving a spurious response by setting the stop-band as a specified frequency band by applying a constant defect to a ground-side of microstrips. The method improves the spurious response at the specific frequency band. However, beyond the aimed the specific frequency band, its effectiveness is disappeared or another spurious characteristic may appear in another frequency band.

SUMMARY OF THE INVENTION

It is, therefore, an object of the present invention to provide a lowpass filter for effectively suppressing a spurious characteristic due to a periodic characteristic of a transmission line with respect to frequency using an open-ended microstrips employing thick/thin resistors.

In accordance with an aspect of the present invention, there is provided a lowpass filter, including: an input port microstrip element; an output port microstrip element; a first open-ended microstrip element connected to the input port microstrip element, having resistance elements both located in predetermined portion of the first open-ended microstrip line and being operated as a capacitor; a second open-ended microstrip element connected to the output port microstrip element, having resistance elements both located in predetermined portion of the microstrip line and being operated as a capacitor; a third open-ended microstrip element connected between the first open-ended microstrip element and the second open-ended microstrip element, having resistance both located in predetermined portion of the microstrip line, and being operated as a capacitor; a first connector microstrip element for connecting the first open-ended microstrip element and the second open-ended microstrip element and being operated as an inductor; and a second connector microstrip element for connecting the second open-ended microstrip element and the third open-ended microstrip element and being operated as an inductor.

The lowpass filter including microstrip have at least one open-ended microstrip element of which a predetermined portion is removed and distributed resistances inserted both located in predetermined portions of the open-ended microstrip.

The open-ended micro strip element of the lowpass filter includes distributed elements and distributed resistances connected to each other in series and operated as a capacitor, wherein distributed resistance increases impedance of the microstrips in case of a low frequency and decreases the impedance of the microstrips in case of a high frequency.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE INVENTION

Figure 4:
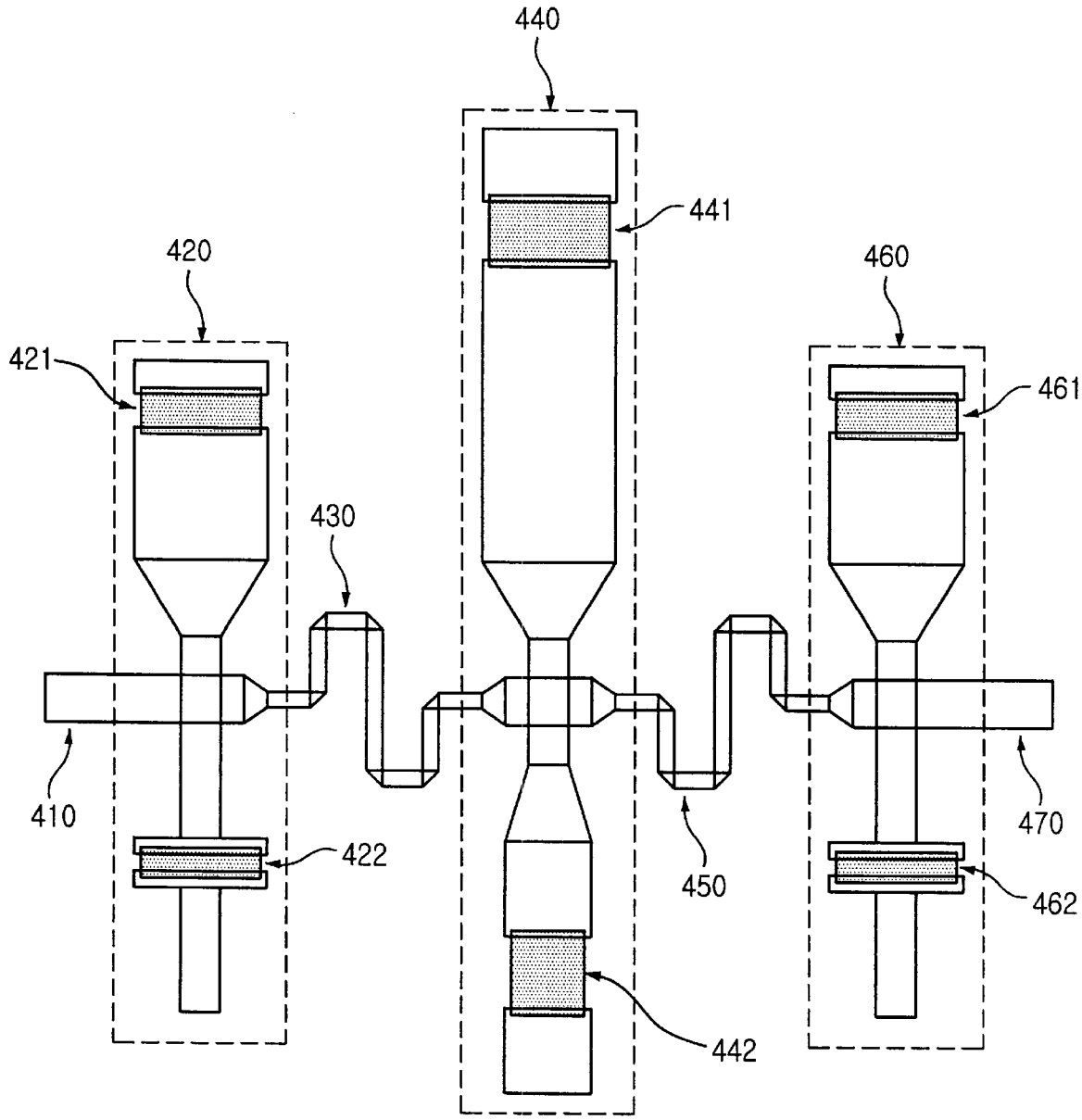
FIG. 4 is a structure diagram of a lowpass filter in accordance with a preferred embodiment of the present invention.

Referring to FIG. 4, a lowpass filter in accordance with the preferred embodiment of the present invention is a circuit composed of open-ended microstrips 420, 440 and 460 and distributed resistances 421, 422, 441, 442, 461, 462. The distributed resistances are resistance elements inserted in gaps within the open-ended microstrips. First and second connector microstrip elements 430 and 450, operating as inductors, connect the open-ended microstrips 420 to the open-ended microstrips 440, and the open-ended microstrips 440 to the open-ended microstrips 460, respectively.

Figure 1:
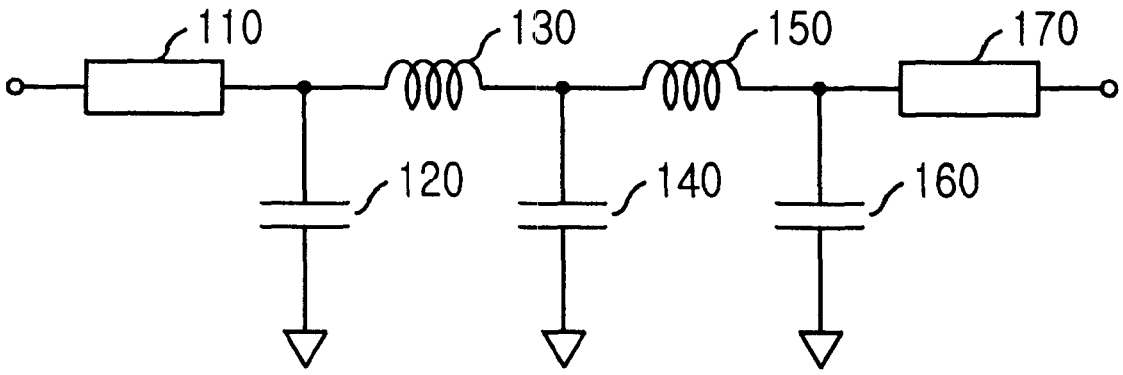
FIG. 1 (PRIOR ART)
FIG. 1 is a circuit diagram illustrating a conventional lowpass filter having conventional lumped elements.
Figure 2:
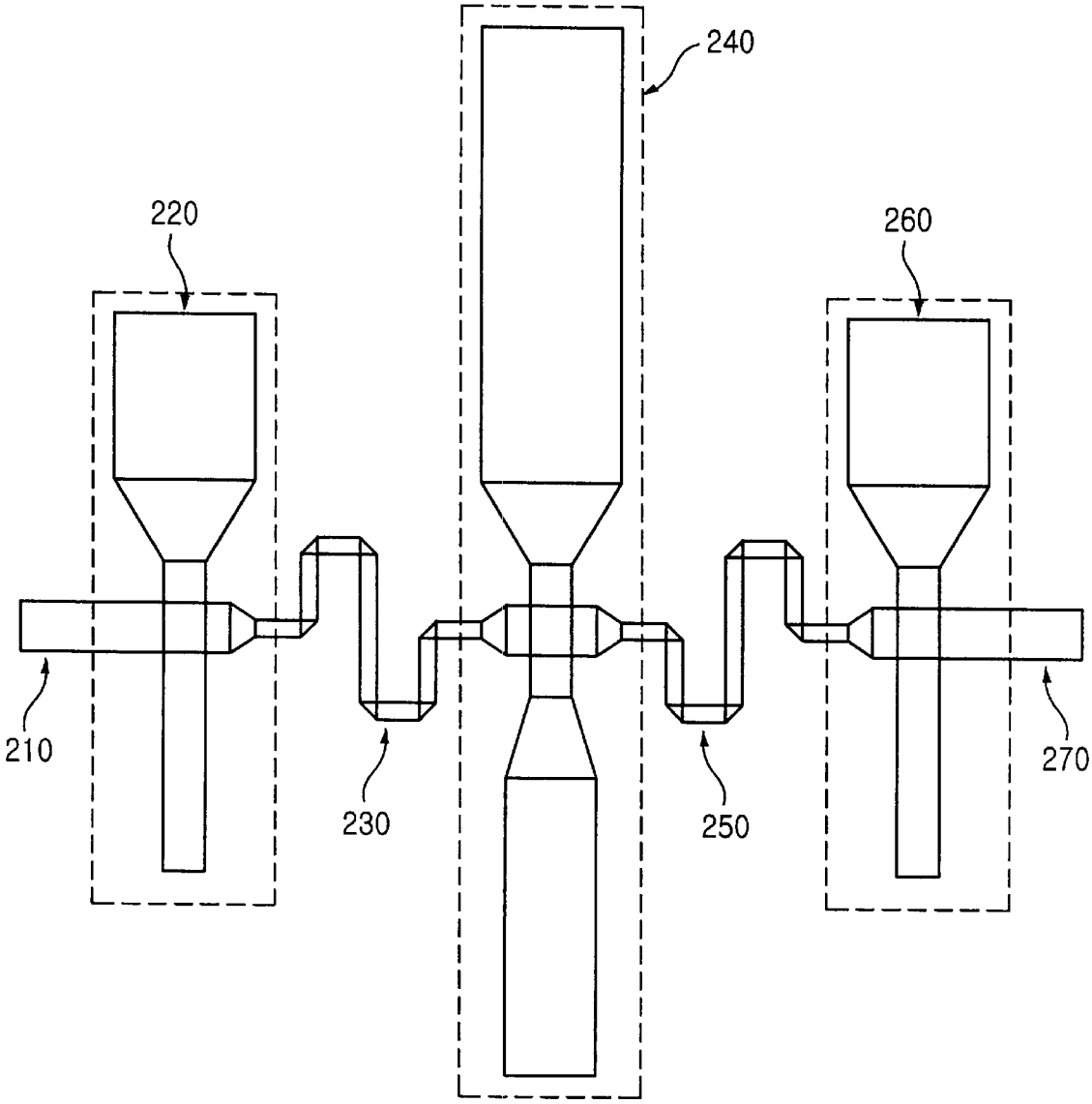
FIG. 2 (PRIOR ART)
FIG. 2 is a circuit diagram illustrating a conventional lowpass filter having microstrips.

As comparing with a conventional lowpass filter having no resistance of FIG. 2, the lowpass filter in accordance with the present invention has the distributed resistances 421, 422, 441, 442, 461 and 462. The distributed resistances affect spurious response of the lowpass filter. The effect of inserting resistors will give greater influence to the impedance at the higher frequency band. The effect is immaterial in a pass band of the lowpass filter, however, the effect gives great influences to the spurious characteristic in the stop-band by increasing the frequency band.

The each open-ended microstrip 420, 440 and 460, which has distributed microstrip elements and distributed resistances connected each others in series, is operated as a capacitor, therefore, in case of the low frequency, an impedance of the microstrip circuits is increased by immaterial effect of a resistance. However, in case of the high frequency, the impedance of the microstrip circuit is decreased by the large effect of the resistance.

A resonance causes appearing the spurious characteristic in the stop-band of the high frequency and the resonance is generated by a periodic characteristic of the microstrips to a frequency. The distributed resistances 421, 422, 441, 442, 461 and 462 are inserted a lowpass filter in accordance with the present invention. The distributed resistances decrease a quality factor of the resonance. Therefore, the present invention improves the spurious characteristic in the stop-band.

The distributed resistances 421, 422, 441, 442, 461 and 462 can be implemented as a film type resistance using a thick film or a thin film. The distributed resistances also can be implemented as a chip-type resistance using a surface mounts technology (SMT) in case an equivalent resistance of lumped elements is accurate.

Additionally, the location of the distributed resistances 421, 422, 441, 442, 461 and 462 may be different according to a wanted frequency band.

Figure 5:
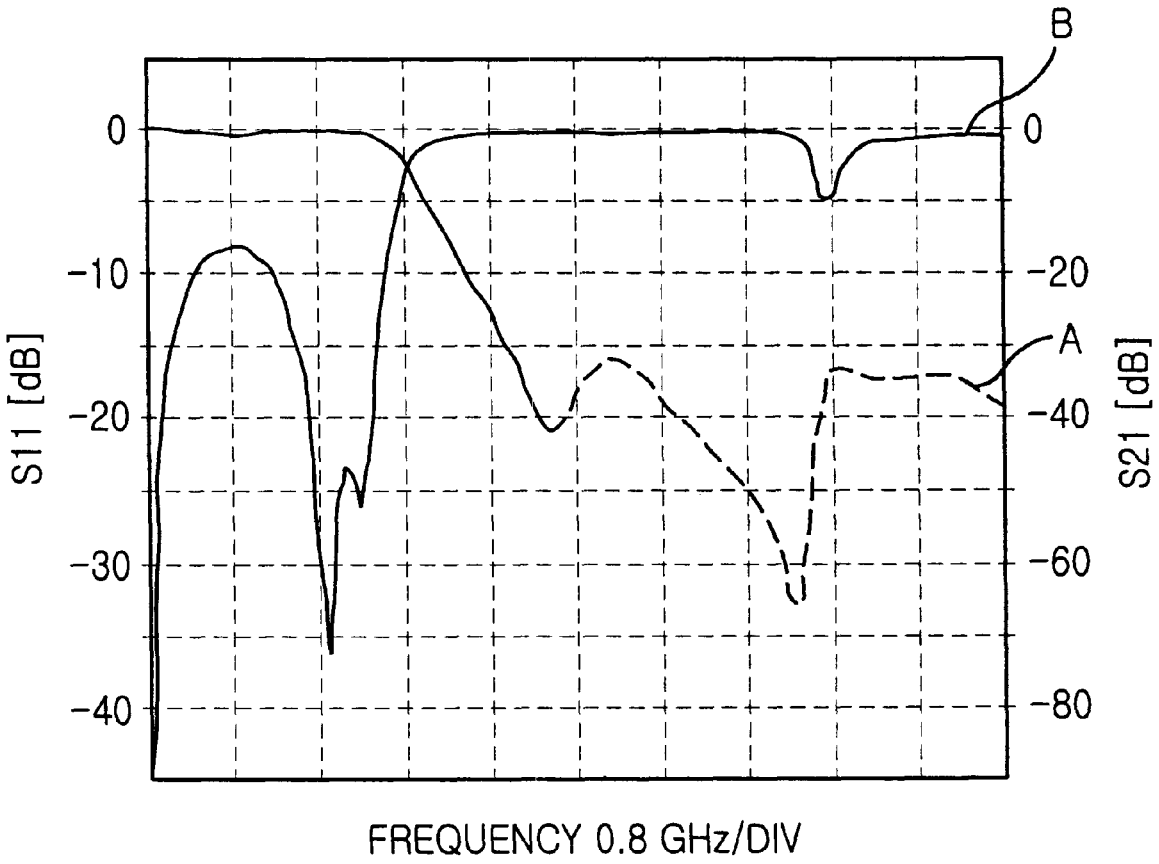
FIG. 5 is a graph showing characteristics of the lowpass filter in accordance with the present invention with a reflection loss and an insertion loss.

Referring to FIG. 5, "A" denotes an insertion loss characteristic of the lowpass filter of the present invention and "B" denotes a reflection loss characteristic of the lowpass filter of the present invention.

Figure 3:
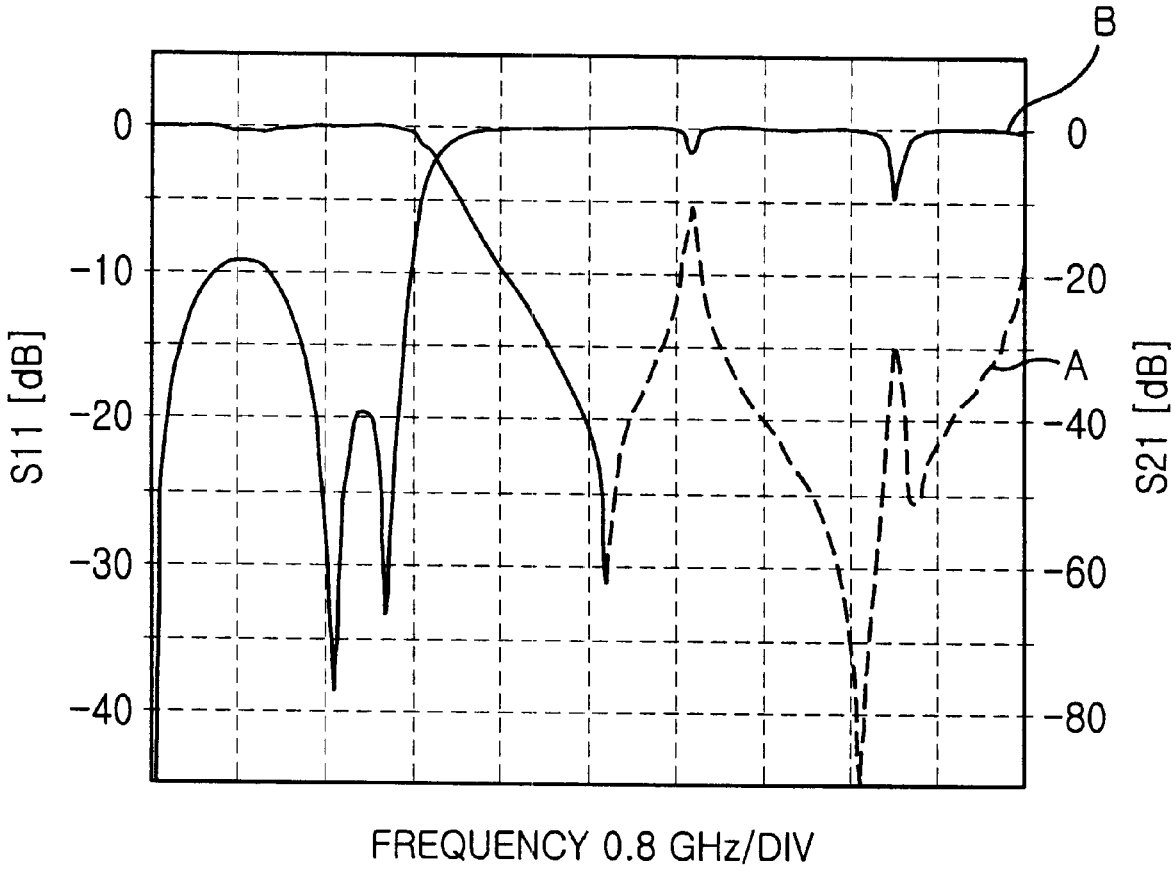
FIG. 3 (PRIOR ART)
FIG. 3 is a graph for depicting characteristics of lowpass filter having microstrip with a reflection loss and an insertion loss.

If a dotted line of FIG. 3 is compared with a dotted line of FIG. 5, the loss characteristic of the present invention is improved the spurious characteristic as at least 20 dB at the stop-band.

The conventional lowpass filter does not suppress the spurious characteristic at the radio frequency (RF) band or the microwave band. By inserting resistance elements in open-ended microstrips of the present invention, the spurious characteristic can be suppressed effectively at broad frequency band.

The lowpass filter in accordance with the present invention also can be used for making a data communication effectively by suppressing the spurious characteristic at the stop-band.

While the present invention has been described with respect to certain preferred embodiments, it will be apparent to those skilled in the art that various changes and modifications may be made without departing from the scope of the invention as defined in the following claims.

What is claimed is:

1. A lowpass filter comprising:

an input port microstrip element;

an output port microstrip element;

a first open-ended microstrip element connected to said input port microstrip element and having a first gap therein, a resistance element positioned across said first gap, the first open-ended microstrip element being operated as a capacitor;

a second open-ended microstrip element connected to said output port microstrip element and having a second gap therein, a resistance element positioned across said second gap, the second open-ended microstrip element being operated as a capacitor;

a third open-ended microstrip element connected between said first open-ended microstrip element and said second open-ended microstrip element and having a third gap therein, a resistance element positioned across said third gap, the third open-ended microstrip element being operated as a capacitor;

a first connector microstrip element for connecting said first open-ended microstrip element and said second open-ended microstrip element and being operated as an inductor; and a second connector microstrip element for connecting said second open-ended microstrip element and said third open-ended microstrip element and being operated as an inductor.

2. The lowpass filter as recited in claim 1, wherein a placement of said first, second and third gaps with associated resistance elements along a length of each of said first, second and third open-ended microstrip elements, respectively, may be varied according to a target frequency band.

3. The lowpass filter as recited in claim 1, wherein said resistance elements include a thick film resistor.

4. The lowpass filter as recited in claim 1, wherein said resistance elements include a thin film resistor.

5. The lowpass filter as recited in claim 1, wherein said resistance elements include a surface mount technology (SMT) type chip resistor.

* * * * *